United States Patent [19]

Fisher

[11] 3,953,070

[45] Apr. 27, 1976

[54] ADJUSTABLE TONGUE FOR SEAT BELT

[76] Inventor: Robert C. Fisher, 4210 N. Dixie, West Palm Beach, Fla. 33407

[22] Filed: Dec. 19, 1974

[21] Appl. No.: 534,224

[52] U.S. Cl. ..... 297/389
[51] Int. Cl.[2] ..... A62B 35/00
[58] Field of Search ..... 280/150 SB; 297/389; 24/75, 77 R, 78; 180/82 C

[56] References Cited

UNITED STATES PATENTS

| | | | |
|---|---|---|---|
| 2,748,436 | 6/1956 | Hoffman | 24/77 R |
| 3,348,881 | 10/1967 | Weman | 297/389 X |
| 3,420,573 | 1/1969 | Holmberg | 297/389 |
| 3,442,529 | 5/1969 | Lewis et al. | 280/150 SB |
| 3,820,842 | 6/1974 | Stephenson | 297/389 |
| 3,876,249 | 4/1975 | Nilsson | 297/389 |

FOREIGN PATENTS OR APPLICATIONS

| | | | |
|---|---|---|---|
| 745,012 | 10/1966 | Canada | 297/389 |

*Primary Examiner*—Donald A. Griffin
*Attorney, Agent, or Firm*—Harness, Dickey & Pierce

[57] ABSTRACT

The disclosure relates to an adjustable tongue and locking device for a vehicle seat belt. One end of the seat belt is anchored to the floor of the vehicle and the other end is attached to a roof mounted retractor. A seat belt buckle accepts the tongue for restraining a passenger in the conventional manner. The adjustable tongue permits the portion of the belt that extends over an occupant's lap to be adjusted to a comfortable length whereupon the roof mounted retractor takes up any slack in the portion of the belt extending over the occupant's shoulders.

The tongue is required to be adjustable so that different sized occupants may use the belt, since the lower end portion thereof is secured to the floor of the vehicle. The tongue is freely slidable downwardly against a stop on the belt when the belt is in the stored condition thereby locating the tongue for ease of access by the occupant.

10 Claims, 18 Drawing Figures

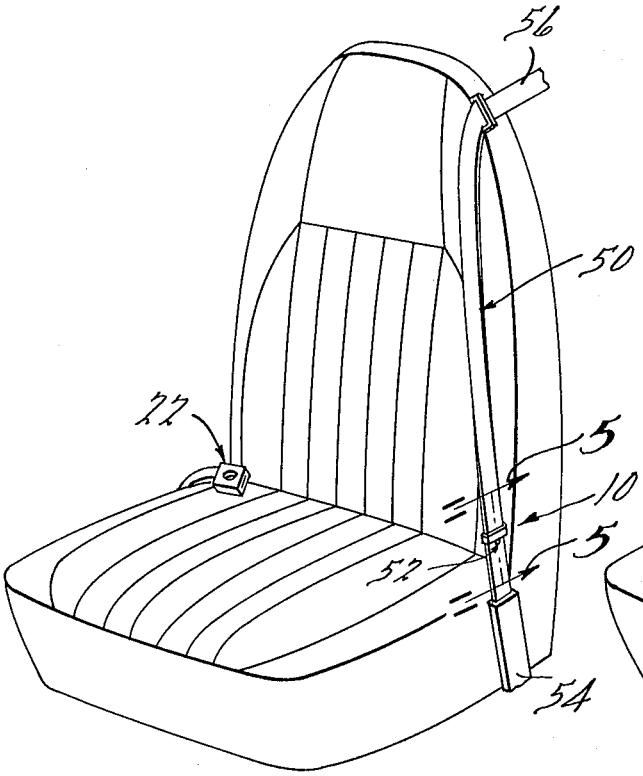
FIG. 1.
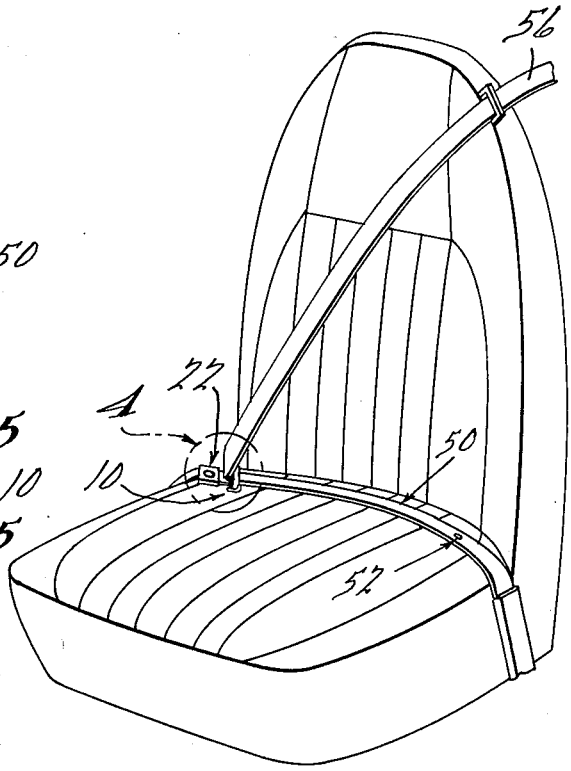
FIG. 2.
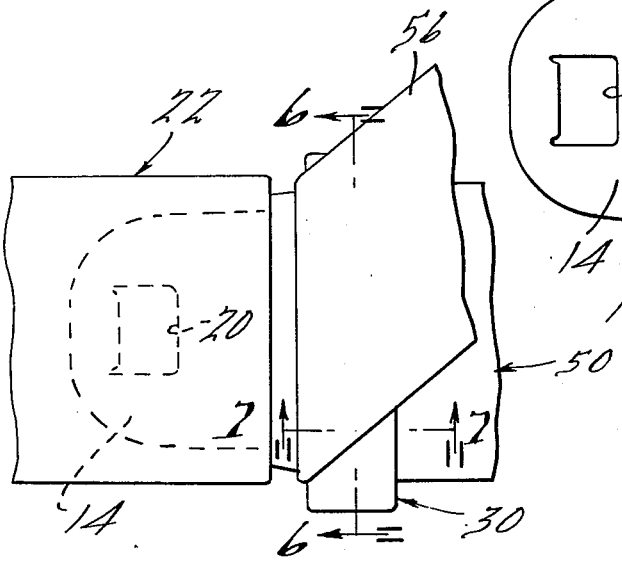
FIG. 4.
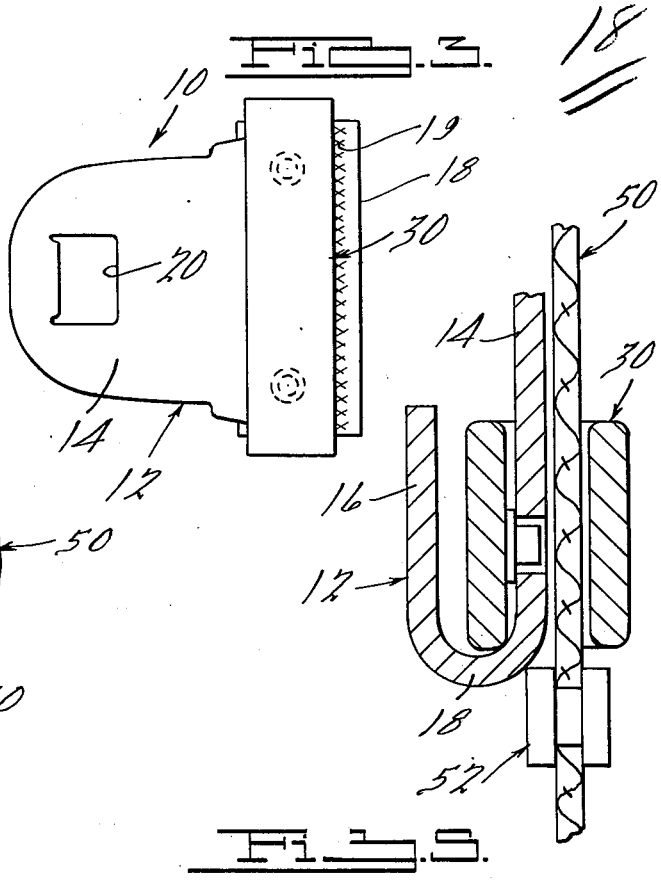
FIG. 3.
FIG. 5.

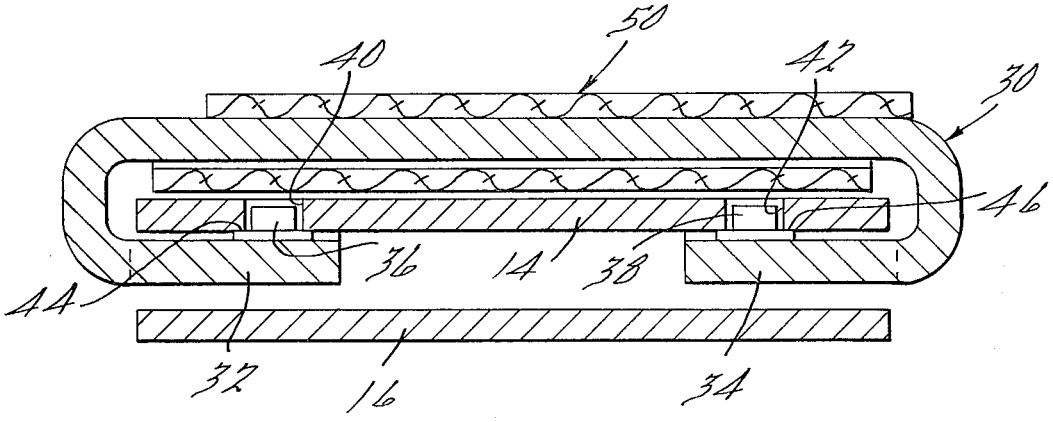
Fig. 6.
Fig. 7.
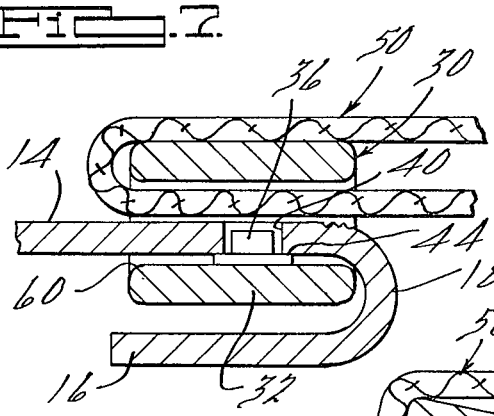
Fig. 8.
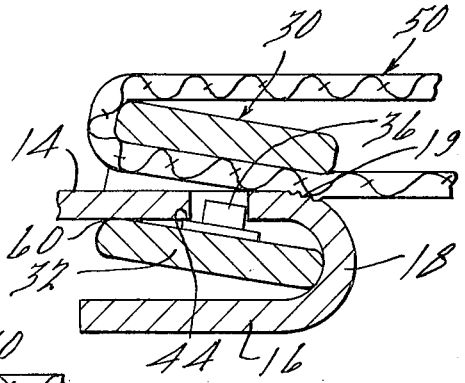
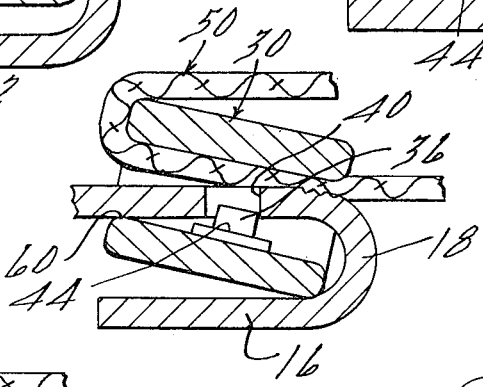
Fig. 9.
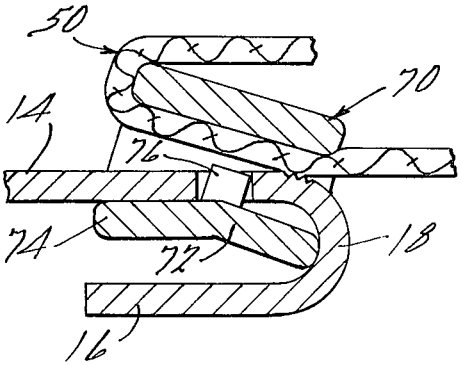
Fig. 10.
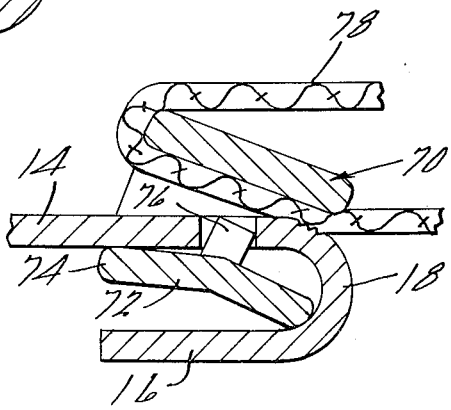
Fig. 11.

ADJUSTABLE TONGUE FOR SEAT BELT

BACKGROUND OF THE INVENTION

Reference may be had to applicant's U.S. Pat. No. 3,725,982 and the art cited therein for a disclosure of related structure.

SUMMARY OF THE INVENTION

An adjustable tongue for a seat belt comprises a U-shaped frame having an elongated leg that functions as a locking portion, a bight portion, and an opposite leg portion that is relatively shorter than the locking portion. A belt bar is pivoted on said frame for the acceptance of a belt therebetween. The tongue is freely slidable relative to the belt in one condition and lockable relative thereto in another condition in a manner that precludes pinching of the belt and distortion of the belt bar upon the occurrence of heavy loads.

BRIEF DESCRIPTION OF THE DRAWINGS

FIG. 1 is a perspective view of the adjustable tongue of the instant invention shown in the storage condition.

FIG. 2 is a view similar to FIG. 1 showing the adjustable tongue in engagement with a seat belt buckle.

FIG. 3 is a top plan view of the adjustable tongue.

FIG. 4 is a view taken within the circle 4 of FIG. 2.

FIG. 5 is a cross-sectional view taken substantially along the line 5—5 of FIG. 1.

FIG. 6 is a cross-sectional view taken substantially along the line 6—6 of FIG. 4.

FIG. 7 is a cross-sectional view taken substantially along the line 7—7 of FIG. 4.

FIG. 8 is a view similar to FIG. 7 with the tongue subjected to a relatively light tensile load.

FIG. 9 is a view similar to FIG. 8 with the belt subjected to a relatively high tensile load.

FIG. 10 is a cross-sectional view, similar to FIG. 8, of a modified form of tongue subjected to a relatively light tensile load.

FIG. 11 is a view, similar to FIG. 10, with the adjustable tongue subjected to a relatively high tensile load.

DESCRIPTION OF THE PREFERRED EMBODIMENT

Figure 12:
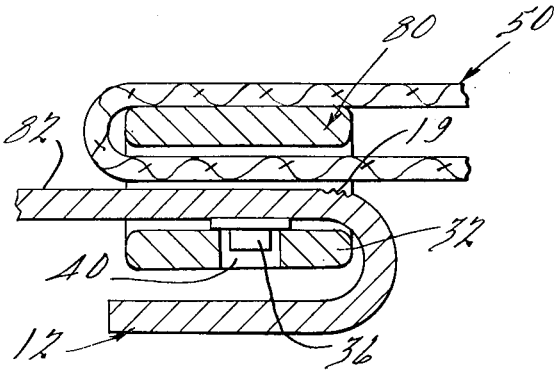
FIG. 12 is a cross-sectional view of structure, similar to that illustrated in FIG. 8, showing another form of the invention.

An adjustable seat belt tongue 10 comprises a U-shaped frame 12 defined by a relatively long leg portion 14 and a shorted leg portion 16 connected by a bight portion 18. The leg portion 14 has an aperture 20 therein for engagement with a complementary latch (not shown) of a buckle 22.

As best seen in FIG. 6, the tongue 10 is provided with a belt bar 30 having reentrantly folded end portions 32 and 34 thereon which are accepted between the leg portions 14 and 16 of the frame 12.

The end portions 32 and 34 of the belt bar 30 are provided with upstanding pins 36 and 38, respectively, that are accepted in complementary apertures 40 and 42 in the leg portion 14 of the frame 12. The pins 36 and 38 are provided with annular collar portions 44 and 46, respectively, which serve to position the leg portions 32 and 34 in spaced relation to the leg portion 14 of the frame 12.

As best seen in FIG. 5 of the drawings, a belt 50 is accepted between the bar 30 and the leg portion 14 of the frame 12 so that the tongue 10 is freely slidable relative to the belt 50 when the belt 50 is orientated in the position shown in FIG. 1 of the drawings wherein the tongue 10 can freely slide downwardly against a stop 52 in the belt 50. A lower end portion 54 of the belt 50 is secured to the floor of a vehicle (not shown), an upper portion 56 of the belt 50 being secured to a conventional locking seat belt retractor (not shown).

When an occupant pulls the tongue 10 across himself, the belt 50 is freely slidable under the belt bar 30 so that tension is developed in the belt that is comfortable to the vehicle occupant. After coupling of the tongue 10 to the buckle 22 as shown in FIG. 4 of the drawings, the seat belt retractor (not shown) retracts the upper portion 56 of the belt 50 to firmly pull the belt 50 across the occupant's shoulders.

In accordance with one feature of the present invention, as best seen in FIG. 4 of the drawings, the upper portion of the belt 50 exerts a lateral tensile force on the belt bar 30 tending to move the bar 30 relative to the frame portion 12 thereof. However, movement of the belt bar 30 is restricted by engagement of the pins 36 and 38 in the apertures 40 and 42 thereby precluding pinching of the edge of the belt 50 between the belt bar 30 and frame 12.

In accordance with another feature of the present invention, relatively light tensile loads on the belt 50 result in rocking the belt bar 30 about the collars 44 and 46 from the position shown in FIG. 7 to the position shown in FIG. 8 of the drawings. The spaced relationship between the collars 44 and 46 and an edge portion 60 of the ends 32 and 34 of the bar 30 is such that a relatively heavy pull on the belt 50 results in pivoting of the bar 30 about the edge portion 60 thereby reducing the mechanical advantage of the leg portion 32 against the lower leg portion 16 of the frame 12. This geometry prevents the belt bar 30 from spreading the legs 14 and 16 upon the occurrence of relatively high loads on the belt 50.

Referring to FIGS. 10 and 11 of the drawings, a modified belt bar 70 is provided with folded end portions 72 having a downwardly deflected edge portion 74 which permits the leg portions 72 to rotate first about a point adjacent the upwardly standing pins 76 thereof, thence about the edge portion 74 due to relatively high tensile loads on a belt 78.

Figure 13:
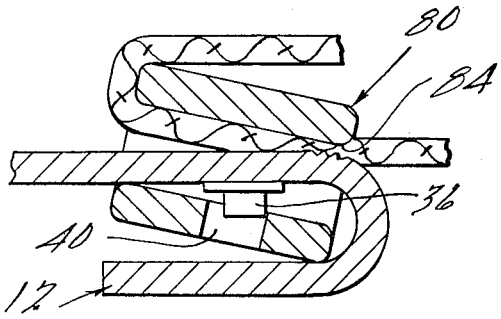
FIG. 13 is a view of the structure illustrated in FIG. 12, with the belt in clamped position.

Referring to FIGS. 12 and 13 of the drawings, a belt bar 80 is illustrated as being employed with the frame 12 and with the pin 36 extending into the aperture 40 in a manner similar to that illustrated in FIGS. 7, 8 and 9. In this arrangement, the downwardly extending pins 36 and 38 are mounted on the long leg portion 14 of the frame 12 and the apertures 40 and 42 are disposed in the end portions 32 and 34 of the belt bar 30. This produces the same snubbing action of the belt at the point 84 against the sections 19 on the frame 12 as produced by the structures illustrated in FIGS. 5 to 11. By maintaining the pins 36 and 38 within the apertures 40 and 42, the belt bar 30 is permitted to rock to clamp the belt against the sections 19 at the point 84 while preventing the bar from shifting laterally or at an angle to the frame 12 due to the pull of the lap and shoulder portion of the belt 50 when disposed across the lap and shoulder of the vehicle's occupant. This clamping of the belt across the lap of the occupant occurs upon the tilting of the belt bar 30 when the frame 12 is secured to the buckle 22 under light load at the point 84. The pin and aperture arrangement prevents the movement of the belt bar 30 relative to the frame to prevent the belt from being pinched at the edges and damaged.

Figure 14:
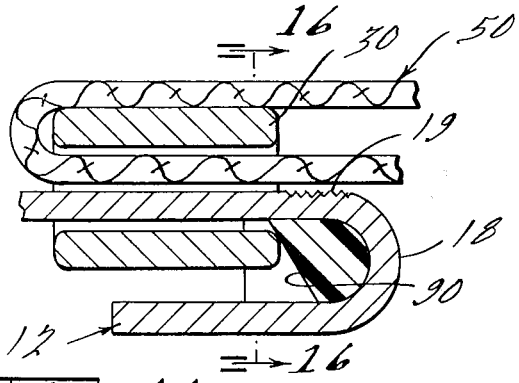
FIG. 14 is a view of structure similar to that illustrated in FIG. 12, showing another form for tilting the clamping bar and preventing the angular and longitudinal movement thereof.
Figure 15:
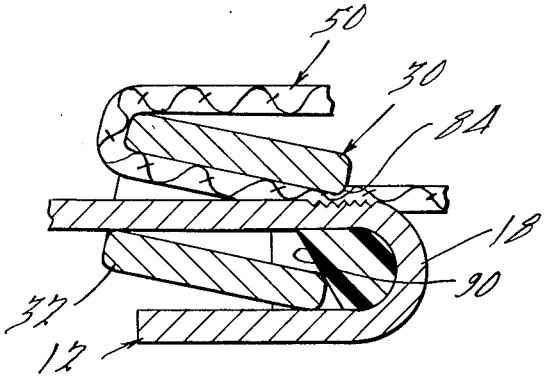
FIG. 15 is a view of the structure illustrated in FIG. 14, with the tilted bar in angular clamping position.
Figure 16:
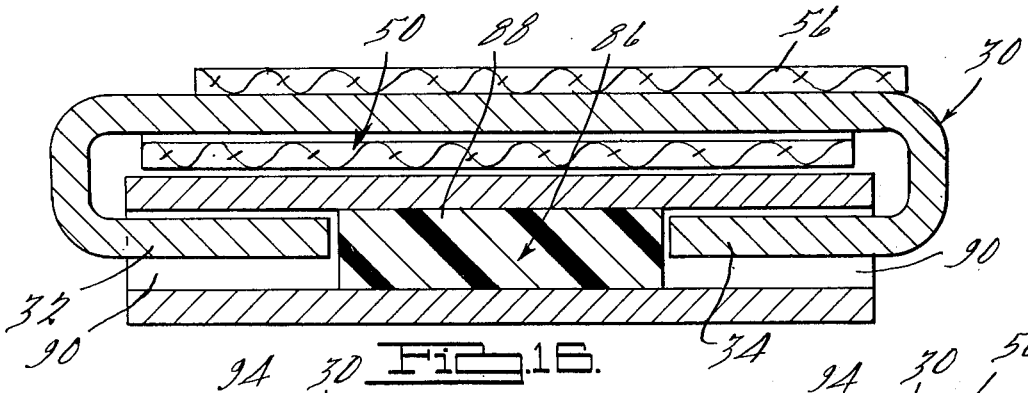
FIG. 16 is a sectional view of the structure illustrated in FIG. 14, taken on the line 16—16 thereof.

Referring to FIGS. 14 to 16, a frame 12 is illustrated having an insert 86 supported within the bight 18 of the frame. The insert is herein illustrated as being made of a plastic material, although other materials, such as metal and the like, could be substituted therefor. The insert has a central portion 88 in position to extend between the ends of the end portions 32 and 34 of the belt bar to prevent endwise shifting while the end sections 90 therebeyond slope at an angle down which the end portions 32 and 34 slide when the frame 12 applies a force to the belt 50. The force tilts the belt bar 80 and pinches the belt at the point 84 when the frame is coupled to the buckle 22.

Figure 17:
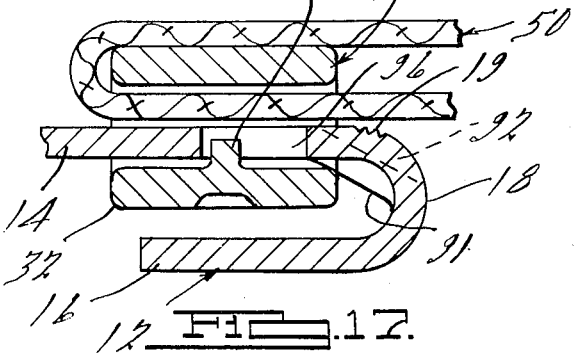
FIG. 17 is a view of structure, similar to that illustrated in FIG. 14, showing a different form of angular ramp which assists in producing the tilting of the belt bar.
Figure 18:
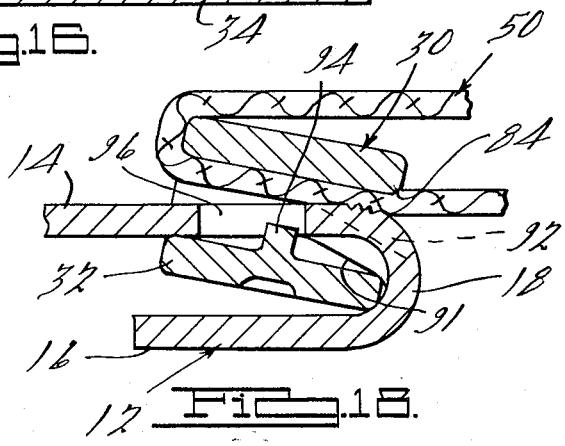
FIG. 18 is a view of the structure illustrated in FIG. 17, with the belt bar tilted and the belt in clamped position.

Similar sloping ramps 91 are provided within the bight 18 of the frame 12, as illustrated in FIGS. 17 and 18. The ramps 91 are formed by deflecting the material inwardly between the legs 14 and 16 at two spaced points 92 in the bight 18. With this arrangement, stamped out heads 94 on the end portions 32 and 34 of the belt bar 30 extend within slots 96 in the long leg 14 of the frame 12. This permits movement longitudinally of the leg 16 by the belt bar 30 which is tilted under a light load assisted by the ramps 91 to pinch the belt when the frame is secured to the buckle 22. This secures the belt across the lap and shoulder of the vehicle's occupant with the pin and slot connection permitting the tilting of the belt bar 30 while preventing movement angularly or longitudinally relative to the frame 12.

I claim:

1. In a seat belt restraint system comprising a seat belt, means for anchoring one end of said seat belt on the floor of a motor vehicle, means for tensioning the other end of said seat belt, the improvement comprising an adjustable tongue freely slidable relative to said seat belt when said belt is in the fully retracted condition, said tongue comprising a frame having means thereon engageable with a seat belt buckle, a belt bar extending generally parallel to and in spaced relation to said frame, said belt passing between said frame and said belt bar, and means on said belt bar engageable with said frame to preclude movement of said belt bar in a direction generally normal to the direction of tension loads on said belt when said belt is in operative position about the occupant of a vehicle.

2. A seat belt system in accordance with claim 1 wherein said engageable means includes means for providing a fulcrum for pivoting said belt bar about a first axis upon the occurence of relatively light loads on said belt and means providing a second fulcrum for pivoting said belt bar about a second axis upon the occurence of relatively heavier loads on said belt.

3. In a seat belt restraint system comprising a seat belt, means for anchoring one end of said seat belt on the floor of a motor vehicle, means for tensioning the other end of said seat belt, the improvement comprising an adjustable tongue freely slidable relative to said seat belt when said belt is in the fully retracted condition, said tongue comprising a U-shaped frame having an aperture on one leg thereof engageable with a seat belt buckle, a belt bar extending generally parallel to and in spaced relation to said frame and having reentrantly folded end portions disposed between the legs of said U-shaped frame, said belt passing between said frame and said belt bar, and means on the end portions of said belt bar engageable with said frame to preclude movement of said belt bar in a direction generally normal to the direction of tensile loads on said belt when said belt is in operative position about the occupant of a vehicle.

4. A seat belt system in accordance with claim 3 wherein said engageable means comprises pins engageable in complementary apertures in said frame.

5. In a seat belt restraint system comprising a seat belt and means for anchoring opposite ends of said seat belt, the improvement comprising an adjustable tongue freely slidable relative to said seat belt when said tongue is not engaged in a complementary buckle, said tongue comprising a U-shaped frame, a belt bar portion extending generally parallel to and in spaced relation to one leg portion of said frame on one side thereof, said belt bar having reentrantly folded end portions disposed between the legs of said frame on the other side of said one leg portion thereof, the spacing of said reentrantly folded portions from the bar portion of said belt bar being greater than the combined thickness of said belt and said one leg portion of said frame whereby said belt is freely slidable between the bar portion of said belt bar and said frame, said belt bar being rotatable about an axis normal to the direction of belt tensile loading to pinch said belt upon the occurrence of such tensile loads and means on said belt bar engageable with said frame to preclude movement of said belt bar in a direction generally normal to the direction of tension loads on said belt when said belt is in operative position about the occupant of a vehicle.

6. In a seat belt retracting device, a unit belt having a lap portion and a shoulder portion, means for securing one end of said belt near the bottom and the other end near the top within a vehicle body, a relatively movable means for taking up the slack in the shoulder portion of the belt after the lap portion has been secured in position, a tongue freely slidable on said belt when the ends are secured near said top and bottom, a buckle to which said tongue is releasably attached to secure said lap portion under a desired tension, said relatively movable means taking up the slack in said shoulder portion of the belt and applying a predetermined tension thereto while preventing protraction of the shoulder portion of said belt after said tongue has been secured to said buckle.

7. In a seat belt retracting device, a unit belt having a lap portion and a shoulder portion, means for securing one end of said belt near the bottom and the other end near the top within a vehicle body, a relatively movable means for taking up the slack in the shoulder portion of the belt after the lap portion has been secured in position, a tongue freely slidable on said belt when the ends are secured near said top and bottom, a buckle to which said tongue is releasably attached to secure said lap portion under a desired tension, said relatively movable means taking up the slack in said shoulder portion of the belt and applying a predetermined tension thereto, wherein said tongue is of U-shape having a bright portion between the short and long leg with the long leg engageable with the buckle, a belt bar disposed across said long leg with the ends reversely bent and extending between said legs, said belt extending between said long leg and said belt bar which is rotated thereby when the tongue is secured to the buckle to provide a positive holding force at the point where the belt is pinched between the belt bar and tongue.

8. In a seat belt as recited in claim 7, wherein interconnecting means are provided between the belt bar and tongue which permits the tilting of the belt bar but prevents angular or endwise movement thereof.

9. In a seat belt as recited in claim 7, wherein an element within the bight portion of the tongue has a portion extending between the ends of the reversely bent ends of said bar and a sloping surface at each end of said extending portion on which the bar tilts.

10. In a seat belt as recited in claim 7, wherein sloping ramps in the bight portion of said tongue assist in the rotation of the belt bar and the pinching of the belt.

* * * * *